US005293147A

United States Patent [19]

Oh et al.

[11] Patent Number: 5,293,147

[45] Date of Patent: * Mar. 8, 1994

[54] AUTOMOTIVE HIGH CURRENT FUSE

[75] Inventors: Seibang Oh, Elk Grove; Robert Madland, Schaumburg, both of Ill.

[73] Assignee: Littelfuse, Inc., Des Plaines, Ill.

[ * ] Notice: The portion of the term of this patent subsequent to Jul. 20, 2010 has been disclaimed.

[21] Appl. No.: 32,629

[22] Filed: Mar. 17, 1993

Related U.S. Application Data

[63] Continuation-in-part of Ser. No. 838,969, Feb. 21, 1992.

[51] Int. Cl.[5] ..... H01H 85/143; H01H 85/04

[52] U.S. Cl. ..... 337/227; 337/290; 337/295; 337/201

[58] Field of Search ..... 337/290, 291, 293, 295, 337/296, 186, 201, 205, 227

[56] References Cited

U.S. PATENT DOCUMENTS 4,023,264 5/1977 Schmidt et al. ..... 29/623

4,635,023 1/1987 Oh ..... 337/163

*Primary Examiner*—Harold Broome

*Attorney, Agent, or Firm*—Wallenstein, Wagner & Hattis, Ltd.

[57] ABSTRACT

A fuse for handling normal load currents substantially in excess of about 80 amps, the fuse comprising a metal portion formed of an integral piece of metal having outermost, spaced terminal-forming portions with bolt-anchoring holes therein and a fuse link-forming intermediate portion between the terminal-forming portions. The terminal-forming portions of the metal piece has a rectangular configuration having inner margins spaced from one another. The fuse link-forming portion of the metal piece has an S-shape with one face thereof being co-planar with one of the faces of the terminal-forming portions thereof. The thickness of the S-shaped fuse link is only a fraction of the thickness of the terminal thickness and has outermost legs respectively extending from the opposite sides of the innermost margins of the terminal-forming portions of the metal piece and a central link interconnecting the outermost legs. The central leg has two pairs of spaced notches between which a tin pellet is anchored in an aperture to reduce the melting temperature of the fuse link so that prolonged overload currents will open the fuse link.

15 Claims, 2 Drawing Sheets

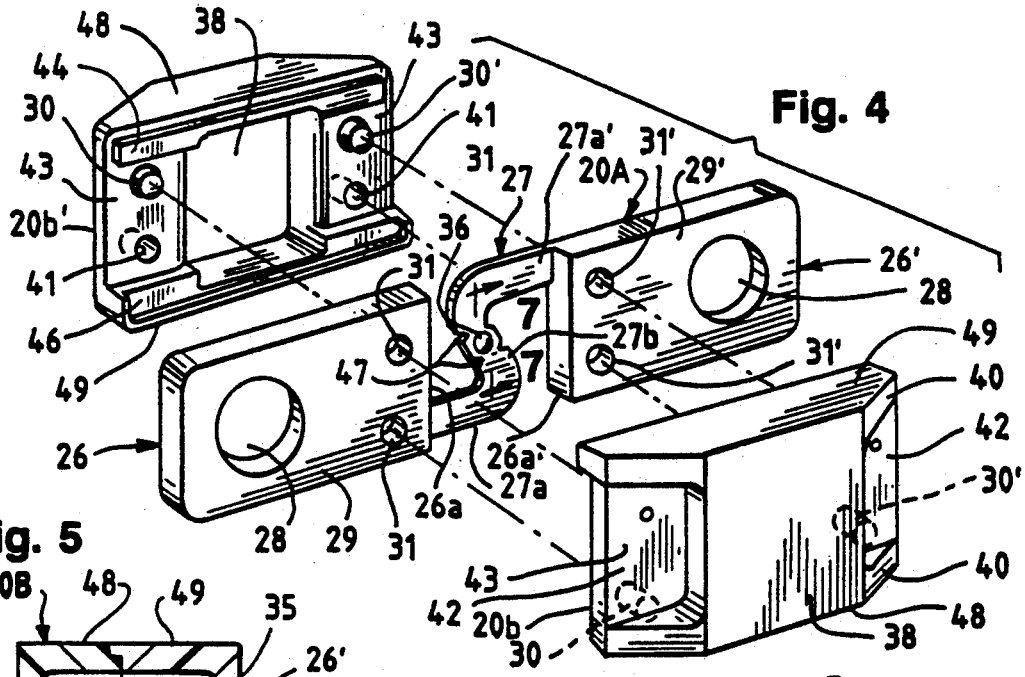
Fig. 4
Fig. 5
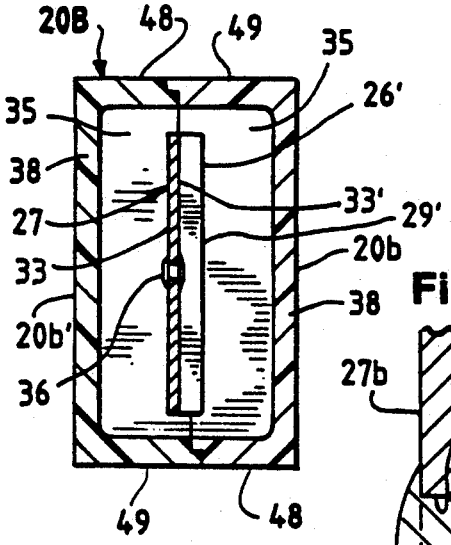
Fig. 7
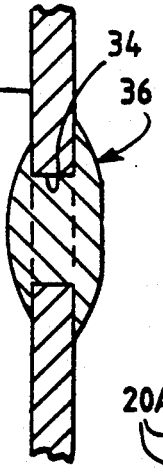
Fig. 6
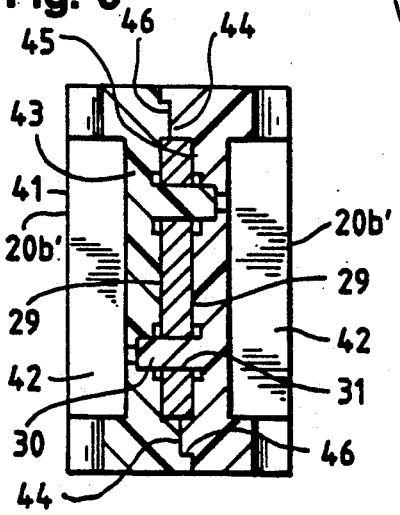
Fig. 8
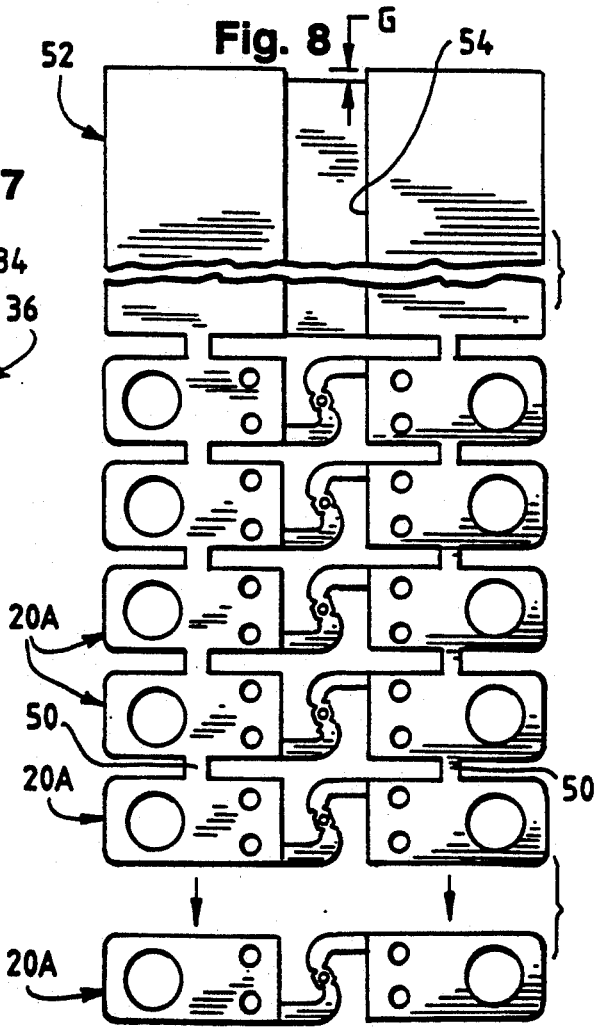

AUTOMOTIVE HIGH CURRENT FUSE

RELATED APPLICATIONS

The present invention is a continuation-in-part application of the pending prior application Ser. No. 07/838,969, filed Feb. 21, 1992, in the names of Seibang Oh and Robert Madland, entitled "Automotive High Current Fuse."

TECHNICAL FIELD

The present invention has its most important application in automotive fuses designed for circuits handling normal currents substantially greater than 80 amps generated at the low voltages produced by storage batteries. These high current automotive fuses are to be contrasted with the plug-in blade fuses disclosed, for example, in U.S. Pat. No. 4,635,023. This patent discloses a fuse now commonly used in vehicle circuits having current ratings of only up to about 80 amps. However, the invention is also useful in fuses with current ratings below 80 amps.

BACKGROUND OF THE INVENTION

The automobile blade-type plug-in fuse disclosed in U.S. Pat. No. 4,635,023 is a two-piece assembly having a thin, box-like housing and a plate-like, all metal plug-in fuse element secured therein. The metal plug-in fuse element has a pair of spaced, confronting, exposed terminal blades extending from one side of the housing. These terminal blades plug into pressure clip socket terminals. Current-carrying extensions of the terminal blades extend into the housing where they are closely encompassed by the housing walls. A fuse link unsupported between the ends thereof extends suspended between the current-carrying extensions and is spaced from the housing side walls.

The fuse link of this and other types of fuses including the fuses of the present invention melts and sometimes vaporizes under fuse blowing conditions. These fuses generally are designed to blow under both prolonged modest overload current like 135% of rated current within ½ hour or instantly under short circuit current. Under such a prolonged modest overload current the temperature of the fuse link progressively rises until the fuse opens the circuit involved. The temperature rise in the fuse link results from electrical power dissipation in the electrical resistance R of the fuse link material due to electrical current I flow therethrough. The formula describing this power dissipation P is $P=I^2R$.

Under normal operation (normal current is usually about 70% of rated current), the heat dissipated in the fuse link is sufficiently small that a large section of the fuse link does not melt or even soften. Heat generated in the fuse link is conducted into the terminal blade portions, housing and panel socket clips. When a current substantially above rated current (like 135% thereof) flows in the link, the heat dissipation is such that there is an insufficient rate of conduction of heat therefrom so that the temperature rises to the temperature which melts the fuse link. The fuse link will soften before it melts, and it is important to the reliability of the fuse that before melting the fuse link does not soften to a degree that the outer portions of the link become so weakened that the center portion sags against a side wall of the housing before the desired fuse blowing conditions occur. If this occurs, the contact made between a sagging fuse link and the housing can melt the fuse housing and cool the fuse link and prevent it from blowing in the desired time period or from blowing at all.

The fuse disclosed in U.S. Pat. No. 4,635,023 was designed to overcome this sagging problem which is not expected to be a problem with fuses carrying substantially in excess of 80 amps where the material of the all metal portion of the fuse involved is made of copper instead of a soft metal like zinc. The teachings of this patent would not, therefore, be expected to be applicable to fuses carrying rated current of 100 amps and above. If one chose to use the fuse design disclosed in this patent to carry such rated currents by increasing the size, thickness and mass of the various portions of the fuse thereshown, the resulting size of the fuse and plug-in socket terminals would be undesirably large.

One of the objects of the present invention is to provide an automotive fuse which can be inexpensively manufactured, and will be of a smaller size than the modified fuse just described.

SUMMARY OF THE INVENTION

The most preferred form of the present invention combines in a unique and unobvious manner the features of three completely different fuse types. Thus, in its most preferred form, it, in part, incorporates some of the features of the most preferred form of the invention disclosed in U.S. Pat. No. 4,635,023, namely an S-shaped fuse link which includes tin or other blowing current-reducing material in the center portions of the fuse link, but placed in a manner completely inconsistent with the teachings of this patent. In its most preferred form, the fuse link of the preferred form of the invention utilizes a feature found only in automotive type blade fuses of 30 amps and less, namely an all metal combined terminal and fuse link mass produced as a stamping from a strip of material having a reduced thickness band running throughout the length of the strip. The terminal and fuse link portions of multiple fuses are stamped sequentially from the strip, with the fuse link being found in the reduced thickness portion of the strip. The formation of a fuse link having a thinner portion than that of the terminals was not incorporated in the higher current rated fuse disclosed in U.S. Pat. No. 4,635,023. A lower current automotive plug-in blade-type fuse made from such a strip is disclosed in U.S. Pat. No. 4,023,264.

Finally, instead of utilizing fuse terminals comprising spaced confronting plug-in terminals as shown by the above patents, a terminal design previously used primarily in industrial fuses is used. Thus, the terminals of the present invention are not confronting plug-in terminals. Rather, they are designed to be anchored by bolts where the bolt-anchoring pressures are such that the much larger contact areas necessary in plug-in connections are not needed. Such terminal designs are common in industrial voltage fuses, although some European car manufacturers use such terminals in high current rated fuses, as is shown in FIG. 1.

As above indicated, the fuse of the most advantageous form of the present invention places tin or other blowing current-reducing material like that used in the plug-in blade fuse disclosed in U.S. Pat. No. 4,635,023 on the fuse link to prevent sagging of the fuse on the fuse link portion of the all metal portion of the fuse which has no sagging problem. Rather, it is placed thereon solely to control the proper blowing conditions under various overload conditions. Also, the tin is positioned completely differently from that used in the fuse of the latter patent. Thus, in all of the preferred forms of the present invention, including the one having very thin sections in the fuse link area, a tin or a similar material is located between spaced notched portions of the fuse link, rather than on opposite sides of a notched area thereof as disclosed in the latter patent. The former tin placement has heretofore been used only in industrial fuses, as shown in FIG. 2.

The above and other features of the invention are described and claimed in the specification and claims to follow.

BRIEF DESCRIPTION OF THE DRAWINGS

FIG. 4 is an exploded view of the fuse of FIG. 3.

FIG. 5 is an enlarged transverse sectional view through the fuse of FIG. 3, taken along a section line 5—5.

FIG. 6 is an enlarged transverse sectional view through the fuse of FIG. 3, taken along section line 6—6.

FIG. 7 is a greatly enlarged transverse sectional view through the center of the fuse link portion of the fuse of FIGS. 3-6, and showing a tin pellet anchored therein, taken along section line 7—7 of FIG. 4.

FIG. 8 is a plan view of a strip of metal from which numbers of the all metal portion of the fuse of FIGS. 3-6 less the tin pellets thereof are stamped.

DESCRIPTION OF PRIOR ART OF FIGS. 1 AND 2

As previously indicated, the present invention in its commercial form carries normal rated load current of at least about 100 amps at voltage levels found in automobiles and other vehicles using DC storage batteries. This fuse is, therefore, in contrast with industrial or other fuses operating at commercial power line voltages. Automotive fuses used in U.S. manufactured automobiles have been fuses of the type heretofore described where a pair of blade terminals project from the fuse housing in spaced parallel confronting relationship and plug into socket terminals. These fuses carried rated current substantially under 100 amps.

Figure 1:
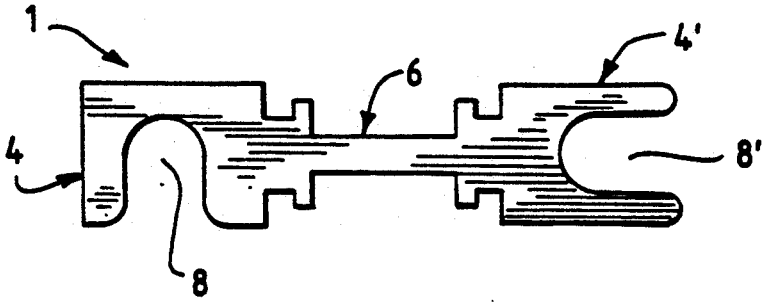
Fig. 1 PRIOR ART
FIG. 1 shows the construction of an automotive fuse link which has heretofore been used to fuse circuits having currents of the magnitude which are handled by the fuse of the present invention.

Some European vehicles manufacturers have heretofore had the need for fusing circuits carrying rated current of 100 amps and above. FIG. 1 shows a fuse manufactured in Europe for such a circuit. It comprises a sheet metal stamping made of copper or the like having outermost terminals 4-4' interconnected by a fuse link 6 of the same thickness and width except for notched or slotting portions thereof. The terminals 4-4' have bolt-receiving apertures 8-8' for respectively receiving bolts for anchoring the fuse in place. The fuse shown in FIG. 1 is sometimes provided with an insulating pad adjacent to the fuse link-forming portion 6. As will appear, the configuration of the fuse link portion of the fuse is vastly different from that of the fuse of the present invention.

Figure 2:
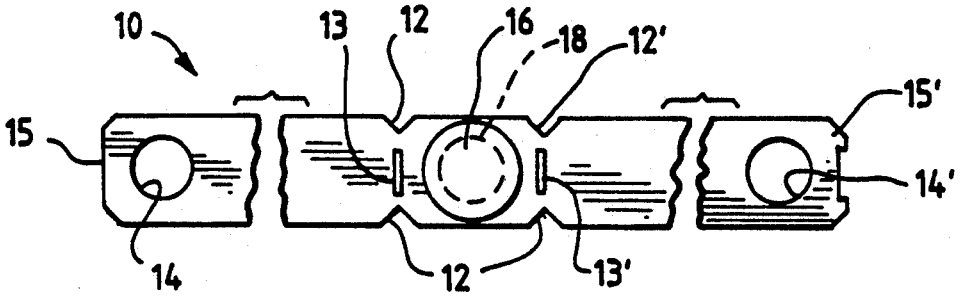
Fig. 2 PRIOR ART
FIG. 2 illustrates a fuse link most closely resembling but still quite different from the fuse link used in the fuse of the present invention, and used heretofore only in high voltage industrial fuses.

FIG. 2 illustrates prior art of the metal portion 10 of an industrial fuse operating in commercial power line voltage energized circuits. It includes a cylindrical insulating housing (not shown). The design of fuses for this environment has heretofore involved substantially different design criteria than those used for fuses in automotive and other vehicles operating in DC storage battery energized circuits. The metal portion 10 has longitudinally spaced and aligned rectangular terminal ends 15-15' which project from this housing. These terminal ends have bolt-receiving holes 14-14'. The terminal ends 15-15' are interconnected by a fuse link-forming portion which is to melt under the overload conditions involved. This fuse link-forming portion has at least two spaced pairs of notches 12—12 and 12'-12'. Frequently, additional pairs of spaced notches are provided along the length of this portion of the fuse. Such a fuse is designed to open under prolonged modest overload levels and also immediately under short circuit conditions. The opening temperature under such conditions is determined by a tin pellet 16 having a lower melting point than that of the metal to which the pellet is connected. The pellet 16 has the shape of a rivet whose shank passes through a circular aperture 18 in the center of the metal piece 10. Under prolonged overload conditions, the pellet 16 becomes molten and diffuses into this metal to cause it to melt at a lower temperature than otherwise would be the case.

Located between the notch pairs 12—12 and 12'—12' are small elongated slits 13 and 13' which, together with the adjacent notches, reduce the cross sectional area at the points involved, to cause the metal piece 10 to immediately melt thereat under short circuit conditions. As will appear, the metal piece 10 differs from the metal piece of the fuse of the present invention in the configuration of the fuse link portion thereof and in the configuration of the preferred housing used therewith.

PREFERRED EMBODIMENT OF THE INVENTION ILLUSTRATED IN FIGS. 3-7

Figure 3:
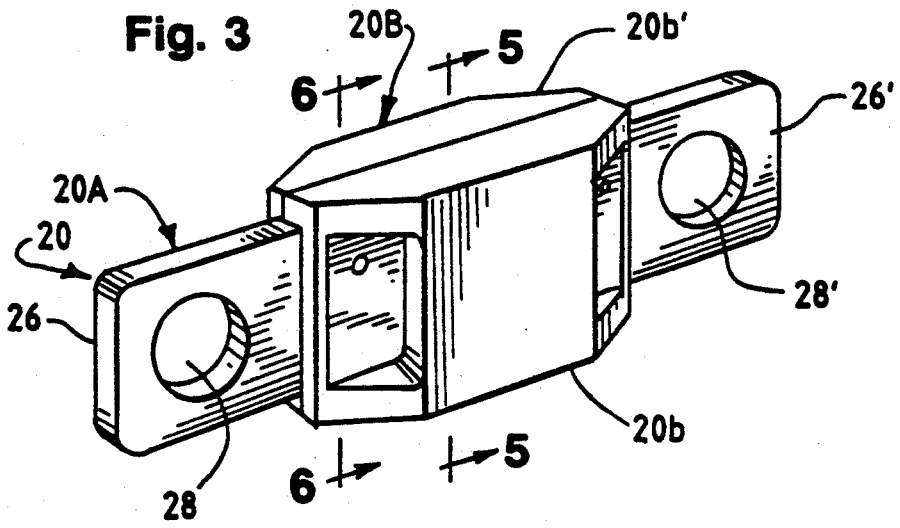
FIG. 3 is a perspective view of the most preferred form of the fuse of the present invention.

Referring now more particularly to FIGS. 3 and 4, the most preferred form of the present invention is a fuse 20 comprising an all metal piece 20A and a two-piece plastic housing 20B. The metal piece 20A can be made of a suitable metal which may, for example, be a copper or copper alloy, which in thin section can form a fuse element when properly configured which melts to open the circuit under both short circuit conditions and under prolonged modest overload conditions. The metal piece 20A has relatively thick outermost, longitudinally aligned and spaced terminal-forming portions 26-26' preferably having a rectangular configuration. The terminal-forming portions 26-26' have confronting, spaced, parallel inner margins or edges 26*a*-26*a*'. Extending between these inner margins is a preferably S-shaped fuse link-forming portion 27 having only a fraction of the thickness of the terminal-forming portions 26-26'.

The S-shaped fuse link-forming portion 27 has outermost, longitudinally extending legs 27*a*-27*a*' respectively extending from the opposite ends of the confronting inner margins, 26*a*-26*a*' forming confronting faces of the terminal-forming portions 26-26'. It is most advantageously of even thickness throughout as are the terminal-forming portions 26-26'. The entire metal piece 20A is stamped from a single piece of sheet metal 52 (FIG. 8)

having a longitudinal, centered groove 54 skived in one face thereof. The terminal-forming portions 26-26' thus have opposite coplanar side faces 29—29 and 29'-29' (FIGS. 4 and 6) and the S-shaped fuse link-forming portion 27 has opposite side faces 33-33' (FIG. 5). The outermost side face 33 is coplanar with the adjacent side faces 29 and 29' of the terminal-forming portions 26-26' and the innermost side face 33' is spaced from the corresponding side faces 29-29' of the terminal-forming portions 26 and 26'.

The S-shaped fuse link-forming portion 27 has an intermediate leg **27*b* having a tin pellet-receiving aperture 34 (FIG. 7). Anchored within this aperture 34 is a rivet-shaped pellet 36 of tin or other metal or alloy having a melting point much lower than that of the metal out of which the metal piece 20A** is made.

On opposite sides of the centered pellet-receiving aperture 34 are laterally aligned pairs of the notches 47—47 serving a function similar to the notch pairs 12—12 and 12'-12' shown in FIG. 2.

The purpose of having an S-shaped fuse link-forming portion 27, as contrasted to the straight rectangular fuse link-forming section of the fuse shown in FIG. 2, is to maximize the mass thereof for a given resistance for low current overloads. The fuses of the automotive type have OEM specifications which require that they open at 350% overload in not less than 100 milliseconds. This desired time lag is best achieved by maximizing the mass of the fuse link within the space between the terminals 26-26', giving the fuse link the greatest length for a given desired resistance. This is achieved by use of an S-shaped fuse link-forming portion 27 having outer legs **27*a*-27*a'* extending longitudinally from the opposite ends of the confronting margins 26-26*a'* of the terminals and an intermediate leg 27*b*** thereof making a reverse inclination (i.e. an acute angle relationship) with the adjacent legs.

Another novel feature of the present invention is the relationship of the housing 20B to the metal piece 26A. To this end, a pair of anchoring pin-receiving holes 31—31 and 31'—31' are provided in the terminal-forming portions 26-26' of the metal piece 20A adjacent the inner margins thereof. As viewed in FIG. 4, the uppermost of these holes 31-31' are adapted to receive positioning pins 30-30' extending inwardly from the rear housing half **20*b'*. The housing halves 20*b*-20*b'* are identical, but one housing half is rotated 180 degrees with respect to the other so that the pins 30-30' of the front housing half are in the bottom portion thereof and extend inwardly through the lower holes 31-31' of the metal piece 20A, as viewed in FIG. 4**.

When the two housing halves **20*b*-20*b'* are in their fully interlocked relationship, the upper pins 30-30' of the rear housing half 20*b'* enter a pair of holes 41-41' in the upper extremity of the front housing half 20*b* and the corresponding pins 30-30' of the front housing half 20*b* enter holes 41-41' in the lower extremity of the rear housing half 20*b'***.

Each housing half is preferably a molded plastic piece and has, as viewed in FIG. 4, a central wall 38 spaced outwardly of and joining a pair of inwardly offset coplanar side walls 43—43. The latter walls are parallel to the wall 38 and present surfaces against which the corresponding faces 29-29' of the terminal-forming portions 26-26' of the metal piece 20A bear when the housing halves are in their fully interlocked positions. In other words, the opposite parallel side faces 29-29' of the terminal-forming portions 26-26' of the metal piece 20A are sandwiched between the inner faces of the side walls 43—43 of the housing halves **20*b*-20*b'***.

Extending inwardly from the inner faces of the outermost side walls 43—43 of each housing half is an elongated positioning rib 44 which extends into a slot 46 formed in the opposite housing half. As shown in FIG. 6, the ribs 44—44 of each housing half fitting into the slots 46 of the other housing half and the confronting surfaces of walls 43—43 form a close and thereby sealing envelopment of the rectangular thermal-forming portions 26—26. The housing halves are preferably made of a thermoplastic material and the interengaging surfaces of the housing halves are ultrasonically welded together.

The central side walls 38 of the housing halves **26*b*—26*b* define therebetween a space 35 from which the S-shaped fuse link-forming portion 27 of the metal piece 20A is spaced. This spacing is best shown in FIG. 5**.

Depending upon the tolerances of the housing parts, the co-planar side walls 43—43 of the housing halves may not tightly engage the opposite flat faces of the terminal-forming portions 26-26' of the metal piece 20A. To avoid such a tolerance problem, the inner faces of these side walls 43—43 can be provided with short deformable nibs or projections (not shown) which are deformed when the two housing halves are pressed together to a point where the pins 30-30' of each housing half enter as fully as possible the apertures 41-41' of the other housing half.

As previously indicated, the metal piece 20A is most advantageously mass produced from a blank of sheet metal 52 which initially has a longitudinal groove 54 skived in one face thereof. This sheet metal strip is moved sequentially to various dies which progressively form the various holes 28-28', 31-31' and 34 and the S-shaped fuse link-forming portion 27 in each section of the strip. The longitudinally spaced portions 20A of the strip 52 are shown in FIG. 8 interconnected by webs 50, which are severed as the end most section of the strip is punched away from the remaining portion of the strip.

While the various dimensions of the all metal piece 20A can vary, one exemplary specification for a 175 amp fuse is as follows:

Overall Dimensions of the Metal Piece 20A

Length of the fuse link-forming portion 27: 0.96"
Thickness of the fuse link-forming portion 27: 0.0225"
Width of the fuse link-forming portion: 0.12"

Dimensions of Notches 47

Length of the terminal-forming portions 26-26': 1.025"
Thickness of the terminal-forming portions 26-26': 0.072"
Width of the terminal-forming portions 26-26': 0.54"
Material of which the piece 20A is made: CA 110 Copper
Material out of which the pellet 36 is made: Pure Tin
Dimensions of the pellet 36 before peening into a rivet shape: 0.05 diameter×0.075" long
supplier for the pellet 36: Kester Solder Corp.
Supplier of the metal piece 20A: Interplex Metals, Inc.
Opening characteristics of the metal piece 20A: At 100% overload, the fuse will not open for at least four hours; at 135% overload, the fuse opens between one and 20 minutes; at 200% overload, the fuse opens between 1 and 30 seconds; at 350% overload, the fuse opens between 0.1 and 10 seconds; and, at 600% overload, the fuse opens between 0.02 and 2 seconds.

The present invention has thus provided a unique, mass-producible, and easy to assemble fuse for fusing circuits with a rated current of the order of magnitude of 100 amps and higher and in low voltage circuits.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

What we claim is:

1. A fuse comprising: a metal portion formed of an integral piece of metal having outermost, spaced terminal-forming portions with bolt-anchoring holes therein and a fuse link-forming intermediate portion wider than its thickness between said terminal-forming portions, the fuse link-forming portion being of a thickness which is only a fraction of the thickness of said terminal-forming portions to provide spaced confronting faces with opposite lateral margins, said fuse link-forming portion having a first outer leg connected only to one of said confronting faces of one of said terminal-forming portions of said metal piece at one lateral margin thereof and an opposite leg connected only to the other confronting face of the other terminal-forming portion of said metal piece at the lateral margin thereof diagonally opposite to said one lateral margin, said fuse link-forming portion providing a desired overall resistance which provides a desired delay in the time a given overload current flow which will melt said fuse link-forming portion and open the fuse, and under short circuit conditions will blow quickly.

2. A fuse comprising: a metal piece having outermost, spaced terminal-forming portions and a fuse link-forming intermediate portion between said terminal-forming portions, said terminal-forming portions of said metal piece being longitudinally spaced and aligned, said fuse link-forming portion providing a desired overall resistance which provides a desired delay in the time a given overload current flow which will melt said fuse link-forming portion and open the fuse, and under short circuit conditions will blow quickly; and an insulating housing surrounding said intermediate portion of said metal piece, said housing comprising identical confronting housing halves having sides placed in confronting relationship along a given plane, each of said confronting housing halves defining a central space therebetween from which said fuse link-forming portion of said metal piece is spaced, said housing halves having confronting surfaces which envelope and seal around the terminal-forming portions of the metal portions of the fuse, each housing half having at least one positioning pin projecting through a pin-receiving hole in one of the terminal-forming portions of said metal piece and a hole in the other housing half, one of said housing halves being rotated 180° in said given plane so that said pin and said pin-receiving holes of said housing halves are at opposite sides thereof.

3. The fuse of claim 1 or 2 wherein said terminal-forming portions of said metal piece are longitudinally spaced and aligned.

4. The fuse of claim 1 or 2 wherein said fuse link-forming portion has a width which is a fraction of the width of said terminal-forming portions.

5. The fuse of claim 1 which is provided with an insulating housing surrounding said intermediate portion of said metal piece.

6. The fuse of claim 2 wherein said terminal-forming portions of said metal piece project longitudinally outwardly from said housing.

7. The fuse of claim 5 wherein said housing comprises confronting housing halves defining a central space therebetween from which said fuse link-forming portion of said metal piece is spaced and having confronting surfaces which envelope and seal around the terminal-forming portions of the metal portion of the fuse.

8. The fuse of claim 2 wherein said fuse link-forming portion has a first outer leg connected only to one of said terminal-forming portions of said metal piece at one lateral inner margin thereof and an opposite leg connected only to the other terminal-forming portion at the opposite lateral inner margin of the other terminal forming portion of said metal piece.

9. The fuse of claim 1 or 2 wherein said fuse link-forming portion is S-shaped.

10. The fuse of claim 2 wherein said fuse link-forming portion of said metal piece has a portion which includes spaced areas of reduced cross-sectional areas forming points of increased resistance where the fuse is expected to melt and open under prolonged overload currents, and a melting temperature-reducing material located between said areas of reduced cross-sectional areas, said melting temperature-reducing material having a melting temperature substantially lower than that of the metal forming said fuse link-forming portion of said metal piece, said material diffusing into said metal piece to reduce the melting temperature thereof in the region between said areas of reduced cross-section.

11. The fuse of claim 10 wherein said areas of reduced cross-sectional area are spaced notches.

12. The fuse of claim 2 wherein said fuse link-forming portion of said metal piece is of the same thickness throughout its length.

13. The fuse of claim 1 wherein said fuse link-forming portion of the metal portion of the fuse has an intermediate leg between said outer legs, said intermediate leg forms an acute angle with the adjacent outer legs of said fuse link-forming portion to increase the overall length of said fuse link-forming portion between the spaced confronting margins of said terminal-forming portion of said metal piece.

14. The fuse of claim 7 wherein each housing half has at least one positioning pin projecting through a hole in the terminal-forming portions of said metal portion of the fuse and entering a hole in the other housing half.

15. The fuse of claim 1 or 2 wherein said metal of said metal portion is made of copper or similar material which will not sag prior to the opening of the fuse.

* * * * *